US007854638B2

(12) United States Patent
Twombly

(10) Patent No.: US 7,854,638 B2
(45) Date of Patent: Dec. 21, 2010

(54) SWIM FIN DEVICE

(76) Inventor: Susan M. Twombly, 112 Chestnut Land Rd., New Milford, CT (US) 06776

( * ) Notice: Subject to any disclaimer, the term of this patent is extended or adjusted under 35 U.S.C. 154(b) by 168 days.

(21) Appl. No.: 12/269,196

(22) Filed: Nov. 12, 2008

(65) Prior Publication Data

US 2010/0120304 A1 May 13, 2010

(51) Int. Cl.
*A63B 31/08* (2006.01)

(52) U.S. Cl. ..... 441/64

(58) Field of Classification Search ..... 441/60, 441/61, 63, 64

See application file for complete search history.

(56) References Cited

U.S. PATENT DOCUMENTS

| | | | | |
|---|---|---|---|---|
| 2,737,668 | A | 3/1956 | Cressi et al. | |
| 3,019,458 | A | 2/1962 | Barbieri et al. | |
| 3,068,499 | A | 12/1962 | Von Biskupsky | |
| 3,112,503 | A | 12/1963 | Girden | |
| 3,239,857 | A | 3/1966 | Gwynne | |
| 3,422,470 | A | 1/1969 | Mares | |
| 3,952,351 | A | 4/1976 | Gisbert | |
| 4,007,506 | A | 2/1977 | Rasmussen | |
| 4,738,645 | A | 4/1988 | Garofalo | |
| 4,752,259 | A | 6/1988 | Tackett et al. | |
| 4,857,024 | A | 8/1989 | Evans | |
| 4,981,454 | A | 1/1991 | Klein | |
| 5,292,272 | A | 3/1994 | Grim | |
| 5,356,323 | A | 10/1994 | Evans | |
| 5,435,764 | A | 7/1995 | Testa et al. | |
| 5,924,902 | A | 7/1999 | Burns et al. | |
| 6,224,443 | B1 | 5/2001 | Mehrmann et al. | |
| 6,309,270 | B1 | 10/2001 | Harwell, IV et al. | |
| 6,398,605 | B1 | 6/2002 | Gibbons et al. | |
| 6,893,307 | B1 | 5/2005 | Melius | |
| 7,140,938 | B1 * | 11/2006 | Ware | 441/64 |
| 7,159,336 | B2 | 1/2007 | Burns et al. | |
| 7,335,076 | B2 | 2/2008 | Hull | |
| 2006/0288610 | A1 * | 12/2006 | Laska et al. | 36/11.5 |
| 2008/0168682 | A1 | 7/2008 | Le | |
| 2008/0184593 | A1 | 8/2008 | Draghiceanu | |
| 2008/0189984 | A1 | 8/2008 | Januszewski et al. | |

OTHER PUBLICATIONS

International Patent Application No. PCT/US09/58712, filed Sep. 29, 2009, claiming priority to the present U.S. Appl. No. 12/269,196 (22 pages).

International Search Report of the International Searching Authority, mailed Nov. 20, 2009, issued in connection with International Patent Appln. No. PCT/US09/58712 (3 pages).

Written Opinion of the International Searching Authority, mailed Nov. 20, 2009, issued in connection with International Patent Appln. No. PCT/US/09/58712 (6 pages).

* cited by examiner

*Primary Examiner*—Daniel V Venne
(74) *Attorney, Agent, or Firm*—McCarter & English, LLP

(57) ABSTRACT

Disclosed herein are apparatus and methods for enhancing swimming and facilitating walking on land. In some embodiments, the apparatus includes a foot thong having a body and a toe tether. The apparatus can include a swim fin device having a sole portion, toe portion, and fin portion, wherein the sole portion and toe portion cooperate to define an opening for receiving the toe tether to secure the swim fin device to the foot thong.

31 Claims, 3 Drawing Sheets

SWIM FIN DEVICE

FIELD OF THE INVENTION

The present invention relates generally to footwear for swimming and, more particularly, to devices for enhancing the speed of a user thereof e.g., a swimmer.

BACKGROUND OF THE INVENTION

It is known in the art to provide a swim fin for propelling a user thereof e.g., a swimmer. The prior art includes apparatus that have a foot portion and a fin portion, where the foot portion is a close-fitting shoe-like structure, and where the fin portion is attached and lengthy relative thereto. While a lengthy fin portion might increase the propulsive force of a swimmer's kick, such can be bulky and difficult to walk in, while the foot portion can be cumbersome to fit onto the foot and limiting by the foot size of the wearer. It is further known in the art to provide a swim fin that includes pivoting or locking mechanisms for purposes of flipping a fin area out of the way or removing it completely. While these mechanisms might surmount the problem of awkward walking on land or into a body of water, it is possible that such may be prone to malfunction or other problems, while preserving the bulky and cumbersome nature of the footwear. What is needed in the art is a swim fin device with enhanced ease of use to overcome these and/or other disadvantages.

SUMMARY OF THE INVENTION

Disclosed herein is a swim fin device that can be provided alone and/or in combination with footwear (e.g., a foot thong) and/or a heel strap.

In a first aspect of the invention, a swim fin device is provided. The swim fin device can include a sole portion for alignment with a sole area of footwear (e.g., a foot thong) and a toe portion extending from the sole portion for alignment with a sole area of the foot thong, where the sole portion and the toe portion cooperate to define an opening for receiving a toe support (e.g., a toe tether) of the foot thong. The swim fin can further include a fin portion extending from the toe portion. The sole portion, the toe portion, and the fin portion can be integrally formed, substantially continuous, and/or substantially planar.

In a second aspect of the invention, a swim fin device is provided in combination with a foot thong. The foot thong can include a body with a first surface and a second surface opposite thereto, and further includes a toe tether having an end, which is referenced herein as an anchor, and which can be secured to the body proximal the first surface. The swim fin can be (i) secured proximal the first surface, (ii) include at least one portion in alignment with the foot thong and defining an opening that receives the toe tether, and (iii) include a fin portion extending from the at least one portion. A heel strap can be provided with ends that are attachable to corresponding ends of the toe tether.

Additional features, functions and benefits of the disclosed swim fin device, combinations including the swim fin device, and methods of use shall be apparent from the detailed description which follows, particularly when read in conjunction with the accompanying figures.

BRIEF DESCRIPTION OF THE DRAWINGS

For a more complete understanding of the present invention, reference is made to the following detailed description of exemplary embodiment(s) considered in conjunction with the accompanying drawings, in which.

DETAILED DESCRIPTION OF EXEMPLARY EMBODIMENTS

Figure 1:
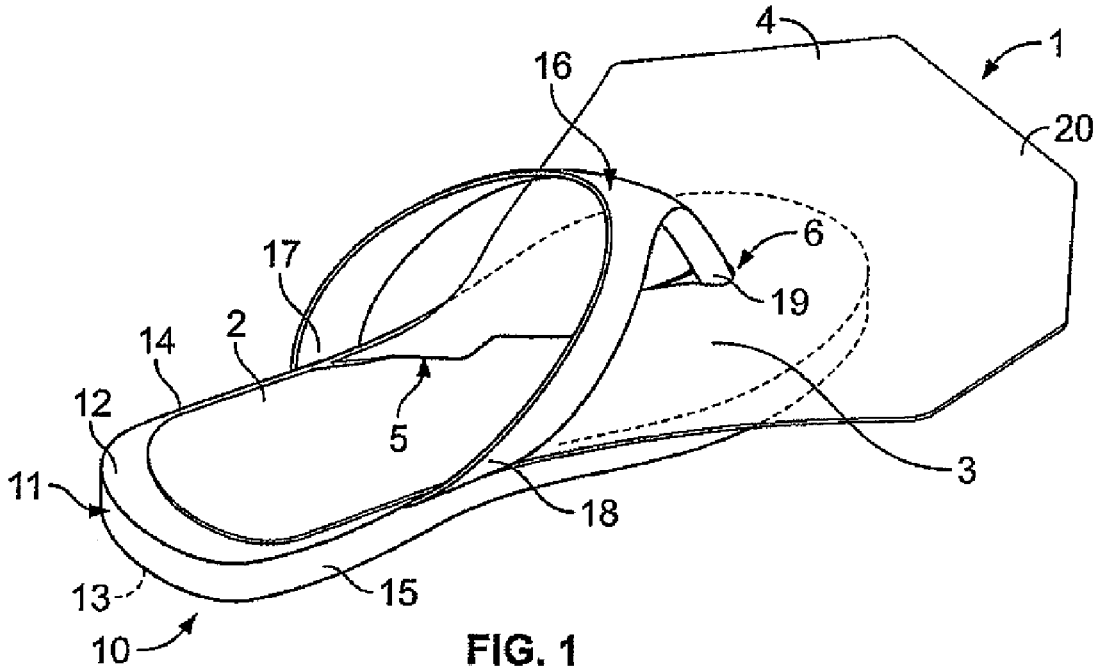
FIG. 1 is a perspective view of a swim fin device constructed in accordance with an exemplary embodiment of the present invention, the swim fin device being shown in combination with a foot thong.

Referring to FIG. 1, for example, a swim fin device 1 is shown constructed in accordance with an exemplary embodiment of the present invention.

The swim fin device 1 is shown in combination with a foot thong 10. The foot thong 10 includes a body 11 having: a first surface 12, e.g., a top surface, proximal to where a foot of swimmer is received; a second surface 13, e.g., a bottom surface, that is opposite the first surface 12 and configured to contact the ground when the user is walking on land, such that the body 11 spaces the first surface 12 apart from the ground when a user is walking on land; and a third surface 14 and a fourth surface 15, e.g., side elevational surfaces. The foot thong 10 further includes a toe tether 16 having a first end 17 extending from the third surface 14, a second end 18 extending from the fourth surface 15, and an end, referenced herein as an anchor 19, extending from the first surface 12. It is preferred that the anchor 19 of toe tether 16 be secured to the body 11 at a position at or proximal the first surface 12, such that the foot thong 10 is configured, in use, to separate a big toe of a users foot from the remaining toes of a user's foot. It is contemplated that any suitable footwear (e.g., a foot thong) and toe support (e.g., a toe tether) can be utilized, and it is further contemplated that the ends 17, 18 of the toe tether 16 (or other toe support) can extend from any surface of the foot thong 10 or other footwear. The footwear (e.g., a foot thong) is preferably formed of a water resistant material and, in this regard, is preferably formed of plastic or natural or synthetic rubber. It is contemplated that the footwear can comprise a shoe.

Continuing with reference to FIG. 1, a preferred embodiment of the swim fin device 1 of the present invention is shown. The swim fin device 1 preferably includes a substantially continuous and substantially planar substrate formed of a resiliently flexible material, such as plastic. The material can be natural or synthetic. The swim fin device 1 has a sole portion 2, a toe portion 3 extending from the sole portion 2, and a fin portion 4 extending from the toe portion 3 opposite the sole portion 2. It is contemplated that the swim fin device 1 can include additional structure distinct from and/or integral therewith. The sole portion 2 and toe portion 3 are sized, shaped, and dimensioned to be seated upon the first surface 12, e.g., the top surface, of the foot thong 10, and the fin portion 4 is positioned to be spaced apart from, e.g., elevated off of, the ground during walking, preferably at least about one-quarter inch (¼"), and more preferably about one-quarter inch (¼") to about one-half inch (½"). The sole portion 2 is preferably tapered so as to fit between the toe tether ends 17, 18 of both adult- and junior-size foot thongs. The sole portion 2 can be shaped to fit the sole of a user's foot with a left foot and right foot version.

The swim fin device 1 is securingly attached to the foot thong 10 by means of a scored or slotted opening 5 that can be defined by the sole portion 2 and the toe portion 3. The slotted opening 5 and/or defining structure thereof can be provided with a flexible memory so as flex open and closed for attaching to, remaining attached to, and detaching from the toe tether of a foot thong. The slotted opening 5 extends from about the center of a lateral side edge of the sole portion 2 to the toe portion 3 and terminates at an area referenced herein as a hole 6. The hole 6 is preferably sized, shaped, dimensioned, and positioned so as to receive the toe tether 16 and/or anchor 19 thereof proximal the first surface 12 of the foot thong 10. The hole 6 of the toe portion 3, for example, encircles or circumscribes the anchor 19, thereby attaching the swim fin device 1 to the foot thong 10. A foot of a user can be received between the toe tether 16 and the swim fin device 1. The hole 6 is preferably positioned at a point common to a plurality of adult and junior size foot thongs.

In some embodiments, the sole portion 2 of the swim fin device 1 is abbreviated and tapers between the ends 17, 18 of the toe tether 16 to end short of the heel, while the hole 6 in the toe portion 3 is positioned at the location of the anchor 19 of the toe tether 16 of the foot thong 10 so as to selectively allow attachment to and removal from and to fit multiple sized thongs, such as a foot thong having a first size and a second foot thong having a second size, e.g., adult- and junior-sized foot thongs.

Figure 2:
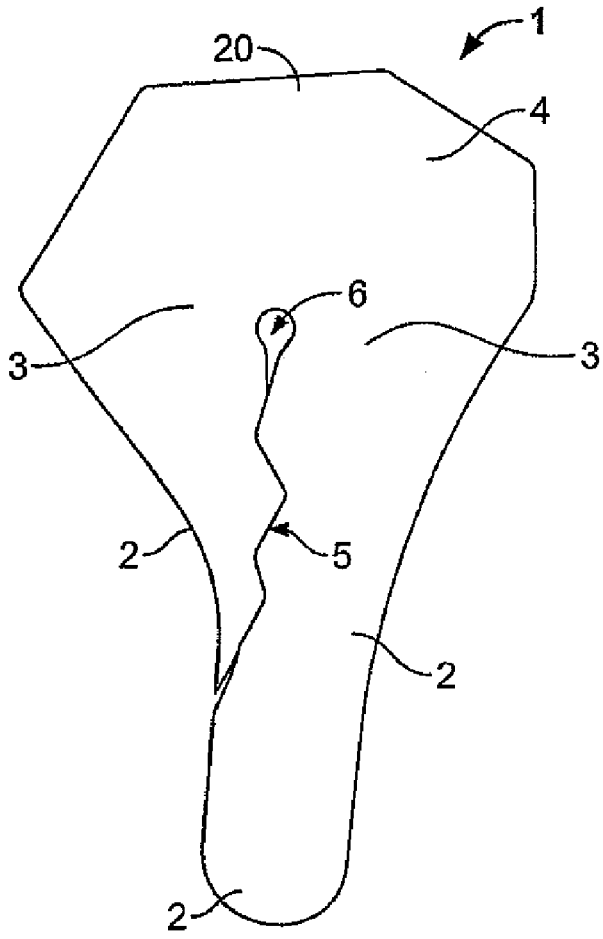
FIG. 2 is a top plan view of the swim fin device of FIG. 1.

Referring to FIG. 2, the swim fin device 1 is shown with further detail to comprise a continuous sole portion 2, toe portion 3, and fin portion, with the slotted opening 5 in the sole portion 2 traversing from the center of the tapered sole portion 2 to the toe portion 3 to terminate at the hole 6, which, as indicated above, is sized, shaped, dimensioned, and positioned to secure to the toe tether 16 of the foot thong 10. Lateral side edges of the toe portion 3 fan out and extend at a wider angle through to the fin portion 4 and can terminate at an end 20 that angles inwardly to converge, e.g., one-hundred and eighty degrees. In preferred embodiments of the invention, the end 20 is about three inches from that position of the swim fin device 1 configured for alignment with a toe edge of the foot thong 1. In this regard, it is preferable that the fin portion 4 extend beyond a perimeter of the foot thong 10, and it is preferably that the sole portion 2 and the toe portion 3 be positioned within a perimeter of the foot thong 10.

Figure 3:
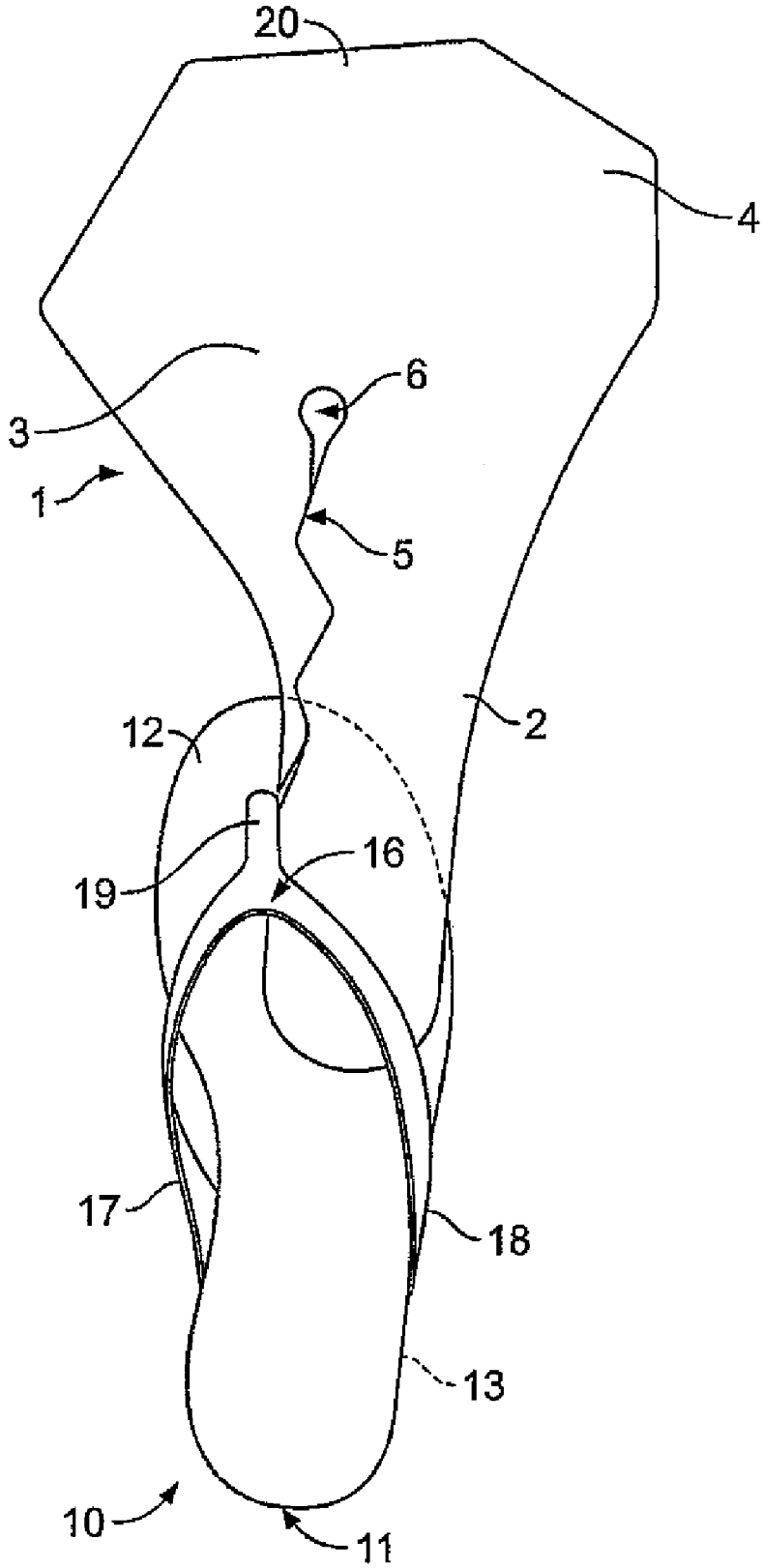
FIG. 3 is a schematic showing the swim fin device of FIGS. 1 and 2 being assembled with the foot thong of FIG. 1.

Referring to FIG. 3, a schematic is provided to show the swim fin device 1 being assembled with the foot thong 10. In the embodiment shown, the slotted opening 5 extends from about the center of a lateral side edge of the sole portion 2 to the toe portion 3 to terminate at the hole 6, which is of the approximate size of and at the location of the anchor 19 of the toe tether 16 of the foot thong 10. The swim fin device 1 is flexed, and the slotted opening 5 is opened (while retaining the flex memory) and the anchor 19 is slid or otherwise inserted into the opening 5 until the anchor 19 is received by the hole 6, which encircles the anchor 19 of the toe tether 16, attaching the recreational swim fin device 1 to the foot thong 10. When the swim fin device 1 and the foot thong 10 are assembled, the sole portion 2 and the toe portion 3 are seated upon the foot thong 10 and/or first surface 12 thereof so as to be spaced apart from the ground. In some embodiments of the present invention, the lateral side edges of the toe portion 3 fan out to continue at a wider angle through the fin portion 4 and angle inwardly to converge at the end 20. The end 20 can be about three inches longitudinally from the toe edge of the foot thong 10 so as to enable propelling of the user in water at a faster rate of speed due to the increased surface area that the fin portion 4 provides.

Figure 4:
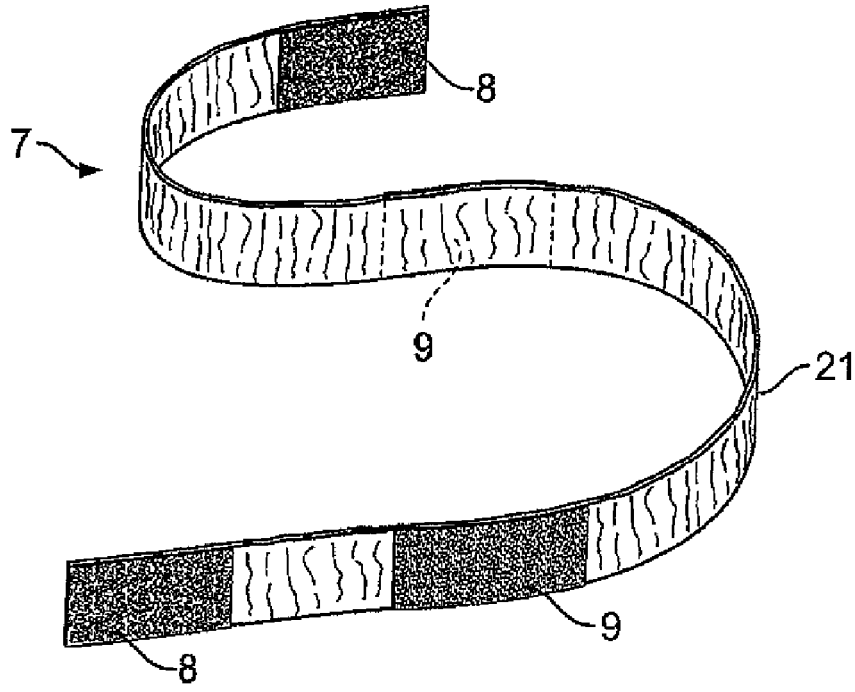
FIG. 4 is a perspective view of a heel strap for use with the foot thong and swim fin device of FIGS. 1-3.

Referring to FIG. 4, the swim fin device 1 can optionally include or otherwise be provided with a heel strap 7. For example, use of the heel strap 7 might be desirable when swimming in turbulent water. The heel strap 7 is preferably stretchable, and can include at ends thereof a plurality of fasteners. The heel strap 7 can include a plurality of strips of conjugable hooked/looped fabric or a "hook and loop fastener," such as a Velcro® hook and loop fastener. For example, the ends of the heel strap 7 can each include a first fastener portion 8 (e.g., a two or three inch strip of the "hook portion"), and a second fastener portion 9 complementary therewith (e.g. a two to three inch strip of the "loop portion") can be spaced apart from the first fastener portion 9, e.g., by about two inches, and away from the center 21 of the heel strap 7.

Figure 5:
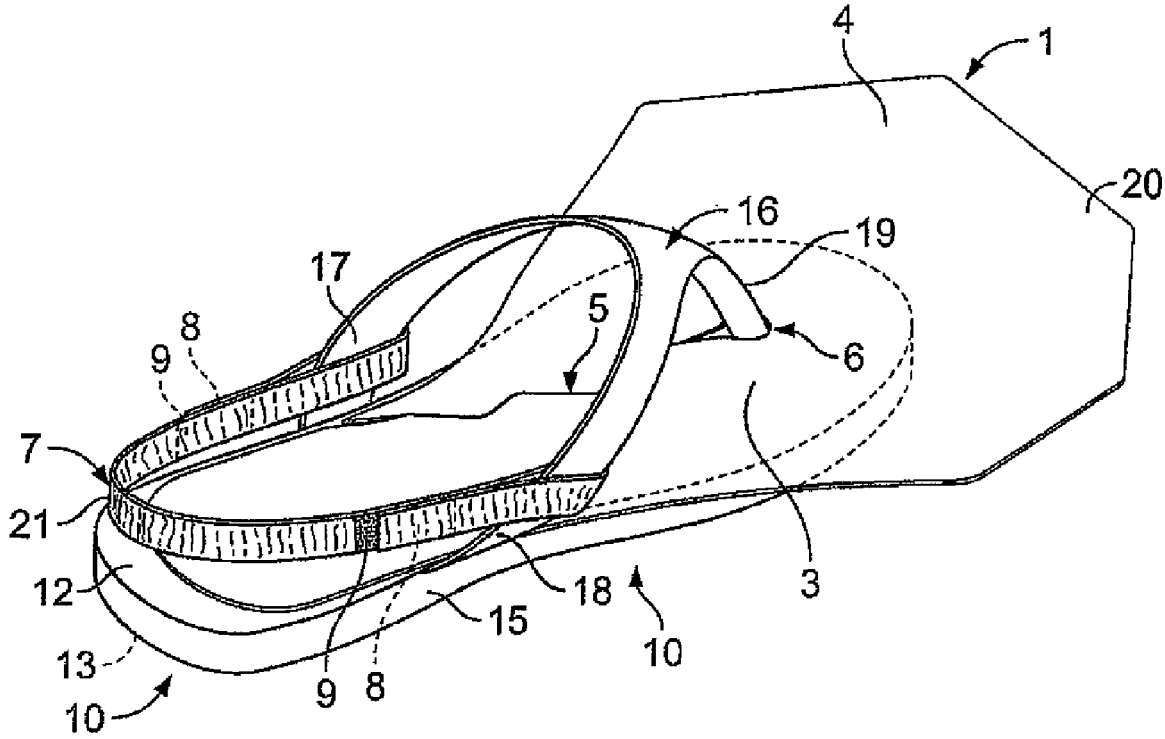
FIG. 5 is a perspective view of the heel strap of FIG. 4 in combination with the foot thong and swim fin device of FIGS. 1-3.

Referring to FIG. 5, the swim fin device 1 is shown to include the heel strap 7 of FIG. 4 and in combination with the foot thong 10. The anchor 19 is securingly received within the hole 6 of the swim fin device 1, and a users foot is received between the toe tether 16 and the swim fin device 1. The heel strap 7 is fastened at ends thereof to the toe tether 16 and extends about the heel of the user so as to facilitate secure positioning of the foot, and it is contemplated that the center 21 of the heel strap 7 can secure the ankle. A first conjugable set of fastener portions 8 and 9 can be fastened proximal the first end 17 of the toe tether 16, and a second conjugable set of fastener portions 8 and 9 are fastened proximal the second end 18 of the toe tether 16. In some embodiments of the invention, the heel strap 7 is substantially free of supplemental fabric that might decrease hugging of the heel strap 7 on the foot and/or ankle.

In some embodiments of the invention, the swim fin device 1 can be characterized as a recreational swim fin unit. It shall be understood that embodiments of the invention may have broad application in use, such as in recreational swimming activities, swim fitness, swim instruction, snorkeling, etc. Moreover, the present invention contemplates recreational and/or non-recreational uses.

In exemplary embodiments of the present invention, the swim fin device 1 accommodates walking on land at least by virtue of the elevation of the swim fin device 1 from the ground. Moreover, the swim fin device 1 is easily worn or removed in or out of the water at whatever interval the user wishes and provides added propulsion and enhanced foot/ankle flexibility while swimming. Preferred embodiments of the present invention provide an open heel and foot design that provides enhanced foot/ankle flexibility, easy removal, and portability. The swim fin device 1 is provided with sufficient flex-memory to provide an open position for attaching and detaching/removing the swim fin device 1 to the toe tether 16 of the foot thong 10 and a closed position for securing the swim fin device 1 to the foot thong 10. A scored opening 5 and/or defining structure thereof can be provided with a flexible memory so as flex open and closed for attaching to, remaining attached to, and detaching from the toe tether 16 of a foot thong 10. In some embodiments, a conventional or standard foot thong known in the art is provided with a conventional or standard toe tether. It is contemplated that the swim fin device 1 alone and/or in combination with the foot thong 10 (and/or heel strap 7) can be provided in adult and/or junior sizes. It is contemplated that the toe tether 16 can be located at a point common among foot thongs known in the art. Other footwear and/or toe supports are contemplated.

The above aspects of the present invention have been given by way of illustrative example. It will be realized that any modifications and variations thereto are deemed to fall within the broad scope and field of the invention as herein set forth including a combination comprising a foot thong and a swim fin device formed integrally therewith, such as a molded, monolithic combination foot thong/elevated swim fin/heel strap (e.g., embodiments of the present invention contemplate a substantially monolithic structure including the foot thong, elevated swim fin device, and heel strap).

While various embodiments of the invention have been described herein, it should be apparent, however, that various modifications, alterations and adaptations to those embodiments may occur to persons skilled in the art with the attainment of some or all of the advantages of the present invention. The disclosed embodiments are therefore intended to include all such modifications, alterations and adaptations without departing from the scope and spirit of the present invention as set forth in the appended claims.

What is claimed is:

1. Apparatus for swimming and walking, comprising:

a foot thong having (i) a body with a first surface and a second surface opposite thereto, and (ii) a toe tether having a first end extending from a first side of said foot thong, a second end extending from a second side of said foot thong opposite said first side, and an anchor secured to said body between said first and second sides to, in use, separate a big toe of a user's foot from remaining toes of the user's foot; and a swim fin device including (i) at least one portion seated upon said foot thong in use and having an opening receiving said anchor of said toe tether in use to so separate the big toe, and (ii) a fin portion extending from said at least one portion.

2. The apparatus of claim 1, wherein said fin portion is integrally formed with said at least one portion.

3. The apparatus of claim 1, wherein said fin portion and said at least one portion form a substantially planar substrate.

4. The apparatus of claim 1, wherein said at least one portion is formed of a resiliently flexible material.

5. The apparatus of claim 1, wherein said at least one portion includes a sole portion and a toe portion extending from said sole portion, and wherein said fin portion extends from said toe portion.

6. The apparatus of claim 5, wherein said sole portion, said toe portion, and said fin portion are integrally formed.

7. The apparatus of claim 6, wherein said sole portion, said toe portion, and said fin portion form a substantially planar substrate.

8. The apparatus of claim 5, wherein said foot thong has one of a first size and a second size, and wherein said sole portion is abbreviated and tapered to be securable with (i) said foot thong, and (ii) a second foot thong having the other one of said first size and said second size.

9. The apparatus of claim 8, wherein said first size comprises an adult size, and wherein said second size comprises a junior size.

10. The apparatus of claim 1, wherein said second surface and said first surface are spaced apart by a distance of at least about one-quarter inch.

11. The apparatus of claim 1, wherein said second surface and said first surface are spaced apart by a distance of between (i) about one-quarter inch, and (ii) about one-half inch.

12. The apparatus of claim 1, comprising a heel strap.

13. The apparatus of claim 12, wherein said heel strap is releasably securable to said foot thong.

14. The apparatus of claim 12, wherein said heel strap is formed of a stretchable elastic material.

15. The apparatus of claim 12, wherein said heel strap includes a plurality of heel strap ends each securable to a corresponding one of said first and second ends of said toe tether.

16. The apparatus of claim 12, wherein said heel strap includes a first set of complementary hook and loop fastener portions and a second set of complementary hook and loop fastener portions, each one of said first and second sets securable to a corresponding one of said first and second ends of said toe tether.

17. The apparatus of claim 1, wherein said foot thong is integrally formed with said swim fin device.

18. The apparatus of claim 1, wherein said fin portion includes (i) an end opposite said at least one portion, and (ii) a plurality of lateral side edges fanning outwardly.

19. The apparatus of claim 18, wherein said end of said fin portion is about three inches from said first surface of said foot thong.

20. The apparatus of claim 1, wherein said opening terminates with a hole sized and shaped to securingly receive said anchor of said toe tether.

21. The apparatus of claim 20, wherein said hole is located at a point common to a plurality of adult size foot thong toe tethers and junior size foot thong toe tethers.

22. The apparatus of claim 1, comprising a kit including said foot thong and said swim fin device in at least one of an assembled state and a disassembled state.

23. A swim fin device for use with a foot thong having a toe tether for separating a big toe of a user's foot from remaining toes of the user's foot, the toe tether having (i) a first end extending from a first side of the foot thong, (ii) a second end extending from a second side of the foot thong opposite the first side, and (iii) an anchor secured to the foot thong between the first and second sides to, in use, so separate the big toe, comprising:

at least one portion formed of resiliently flexible material, said at least one portion having (i) a sole portion, in use, seated upon a sole area of the foot thong, (ii) a toe portion, in use, seated upon a toe area of the foot thong, and (iii) a slotted opening extending from a lateral side edge of said sole portion and terminating at a hole through said toe portion, said at least one portion being flexible between an open position in which said slotted opening allows insertion of the anchor from said lateral side edge to said hole and a closed position in which said hole, in use, circumscribes the anchor to attach said toe portion thereto; and a fin portion extending from said toe portion.

24. The swim fin device of claim 23 in combination with the foot thong.

25. The swim fin device of claim 23 in combination with a heel strap for securing said swim fin device to the foot thong.

26. The swim fin device of claim 23, wherein said sole portion, said toe portion, and said fin portion are integrally formed.

27. The swim fin device of claim 23, wherein said sole portion, said toe portion, and said fin portion form a substantially planar substrate.

28. The swim fin device of claim 23, wherein said sole portion and said toe portion are formed of a resiliently flexible material.

29. The swim fin device of claim 23, wherein said fin portion includes (i) an end opposite said at least one portion, and (ii) a plurality of lateral side edges fanning outwardly.

30. The apparatus of claim 29, wherein said end of said fin portion is about three inches from a surface of the foot thong.

31. The apparatus of claim 23, wherein said hole is located at a point common to a plurality of adult size foot thong toe tethers and junior size foot thong toe tethers.

* * * * *